United States Patent [19]

Kamimura

[11] 4,295,413

[45] Oct. 20, 1981

[54] HYDRAULIC ACTUATOR

[75] Inventor: Toshio Kamimura, Gifu, Japan

[73] Assignee: Teijin Seiki Company, Limited, Osaka, Japan

[21] Appl. No.: 155,743

[22] Filed: Jun. 2, 1980

Related U.S. Application Data

[63] Continuation of Ser. No. 4,534, Jan. 18, 1979, abandoned, which is a continuation-in-part of Ser. No. 807,233, Jun. 16, 1977, abandoned.

[30] Foreign Application Priority Data

Jun. 18, 1976 [JP] Japan ..... 51-71966

[51] Int. Cl.[3] ..... F01B 25/26

[52] U.S. Cl. ..... 92/5 L; 92/24; 92/27

[58] Field of Search ..... 92/5 R, 5 L, 18, 19, 92/23, 24, 27, 28; 91/1, 41, 42, 43, 44, 358 R, 410

[56] References Cited

U.S. PATENT DOCUMENTS

| | | | |
|---|---|---|---|
| Re. 28,967 | 9/1976 | Weiss | 92/27 |
| 3,107,582 | 10/1963 | Royster | 92/24 |
| 3,216,332 | 11/1965 | De Chambeau | 92/5 R |
| 3,359,862 | 12/1967 | Modridi | 91/44 |
| 3,453,937 | 7/1969 | Haberman | 92/5 R |
| 3,584,544 | 6/1971 | Haberman | 92/24 |
| 3,605,568 | 9/1971 | Nepp | 92/24 |
| 3,661,053 | 5/1972 | Rich | 92/5 R |

*Primary Examiner*—Abraham Hershkovitz

*Attorney, Agent, or Firm*—Cushman, Darby & Cushman

[57] ABSTRACT

A hydraulic actuator comprises: a cylinder; a piston axially slidably received in the cylinder and having a hollow bore axially extending therein; at least a locking member radially movably retained in the piston; a ram axially slidably received in the hollow bore of the piston and having an inclined portion connecting a lower engaging portion and an upper engaging portion with a circumferential length longer than that of said lower engaging portion, said inclined portion being slidably engageable with the radially inner face of the locking member for radial movement thereof; a switch piston radially slidably mounted on the cylinder to have a radially inner face engageable with the radially outer face of the locking member; and detecting means for detecting the piston under conditions locked and unlocked with the cylinder by detecting radial movement of the locking member through the switch piston. One type of the actuators has a stepped portion which is formed on at least one of the inclined portion of the ram and the radially inner face of the locking member.

2 Claims, 11 Drawing Figures

HYDRAULIC ACTUATOR

This is a continuation, of application Ser. No. 4,534 filed Jan. 18, 1979 (now abandoned) in turn a continuation-in-part of Ser. No. 807,233, filed June 16, 1977 (now abandoned).

This invention relates to a hydraulic actuator and more particularly to a hydraulic actuator in which a piston slidably received in a cylinder is temporally locked when the piston slides to the outermost position or positions of the cylinder.

In general, there have been widely adopted such hydraulic actuators for use in extension and retraction of landing wheels as well as movement of doors and the like. Unless the hydraulic actuators can be reliably locked, there may be caused no safe flight for the aircrafts, giving great damages to aircrafts and human lives. For this reason, an electric switch is usually provided in the actuator to detect the operational conditions, i.e., the locked and unlocked condition, of the actuator for confirmation thereof from the exterior. Conventional actuators were so designed that an electric switch operates to transmit a locked signal to exterior or other electric means immediately before the piston is locked, viz., in a semi-locked condition of the piston. The reason is such that it is extremely difficult to always coincide the locked position of the piston with the operation position of the electric switch, resulting from dislocation of the locked position of the piston to be caused by abrasions of piston, ram and locking members involved in the actuator as well as from dislocation of the operation position of the electric switch to be caused by its abrasions and hysteresis. Consequently, the electric switch comes to be energized to have an external indicating meter show the locked position of the piston even if the piston is under the semi-locked condition. If the operation of the locking mechanism remains stopped in such a condition, the aircraft takes a flight under the semilocked condition which is extremely incomplete and unfavorable, thereby causing remarkably unsafe flight to the aircraft. In this instance, the locked condition of the piston is referred to as a condition wherein the piston is not moved even if it is exerted by the external force, while the unlocked condition of the piston is referred to as a condition wherein the piston is moved if it is exerted by the external force.

It is therefore an object of the present invention to provide a hydraulic actuator which has a piston adapted to be completely locked immediately before the electric switch is actuated to transmit a locked signal to the external indicating meter.

The foregoing object will be attained by a hydraulic actuator according to one aspect of the present invention which comprises: a cylinder; a main piston axially slidably received in the cylinder and having a hollow bore axially extending therein; a liquid source system for supplying a liquid to the cylinder to relatively slidably move the cylinder and piston; at least one locking member radially movably retained in the main piston; a ram axially slidably received in the hollow bore of the main piston and having lower engaging portion slidably engageable with the radially inner face of the locking member, an upper engaging portion axially spaced apart from the lower engaging portion with a circumferential length longer than that of the lower engaging portion and slidably engageable with the radially inner face of the locking member, a stepped portion positioned between the lower and upper engaging portions with a circumferential length longer than that of the lower engaging portion but shorter than that of the upper engaging portion and slidably engageable with the radially inner face of the locking member, a first inclined portion connected at one end with the lower engaging portion and at the other end connected with one end of the stepped portion to be slidably engageable with the radially inner face of the locking member for radial movement thereof, and a second inclined portion connected at one end with the other end of the stepped portion and at the other end connected with the upper engaging portion to be slidably engageable with the radially inner face of the locking member for radial movement thereof; a compression coil spring accommodated in the bore of the main piston to urge the ram toward the lower engaging portion from the upper engaging portion; a switch piston radially slidably mounted on the cylinder to have a radially inner face engageable with the radially outer face of the locking member; an indicator for indicating lock and unlock engagement conditions of the cylinder and the main piston; and a detecting electric switch for detecting the radially moved position of the locking member through the switch piston to detect the main piston which is locked and unlocked and for transmitting lock and unlock signals to the indicator, whereby the radially inner face of the locking member is in engagement with the lower engaging portion of the ram to assume an unlock engagement position wherein the main piston is in unlocked relation with the cylinder, the radially inner face of the locking member is in engagement with the stepped portion of the ram to assume a first lock engagement position wherein the indicator indicates the unlock signal even though the cylinder and the main piston are in the first lock engagement condition, and the radially inner face of the locking member is in engagement with the upper engaging portion of the ram to assume a second lock engagement position wherein the indicator remains indicating the lock signal.

The above and other objects, features and advantages of the present invention will become clear from the following particular description of the invention and the appended claims, taken in conjunction with the accompanying drawings which show by way of example a preferred embodiment of the present invention.

Figure 1:
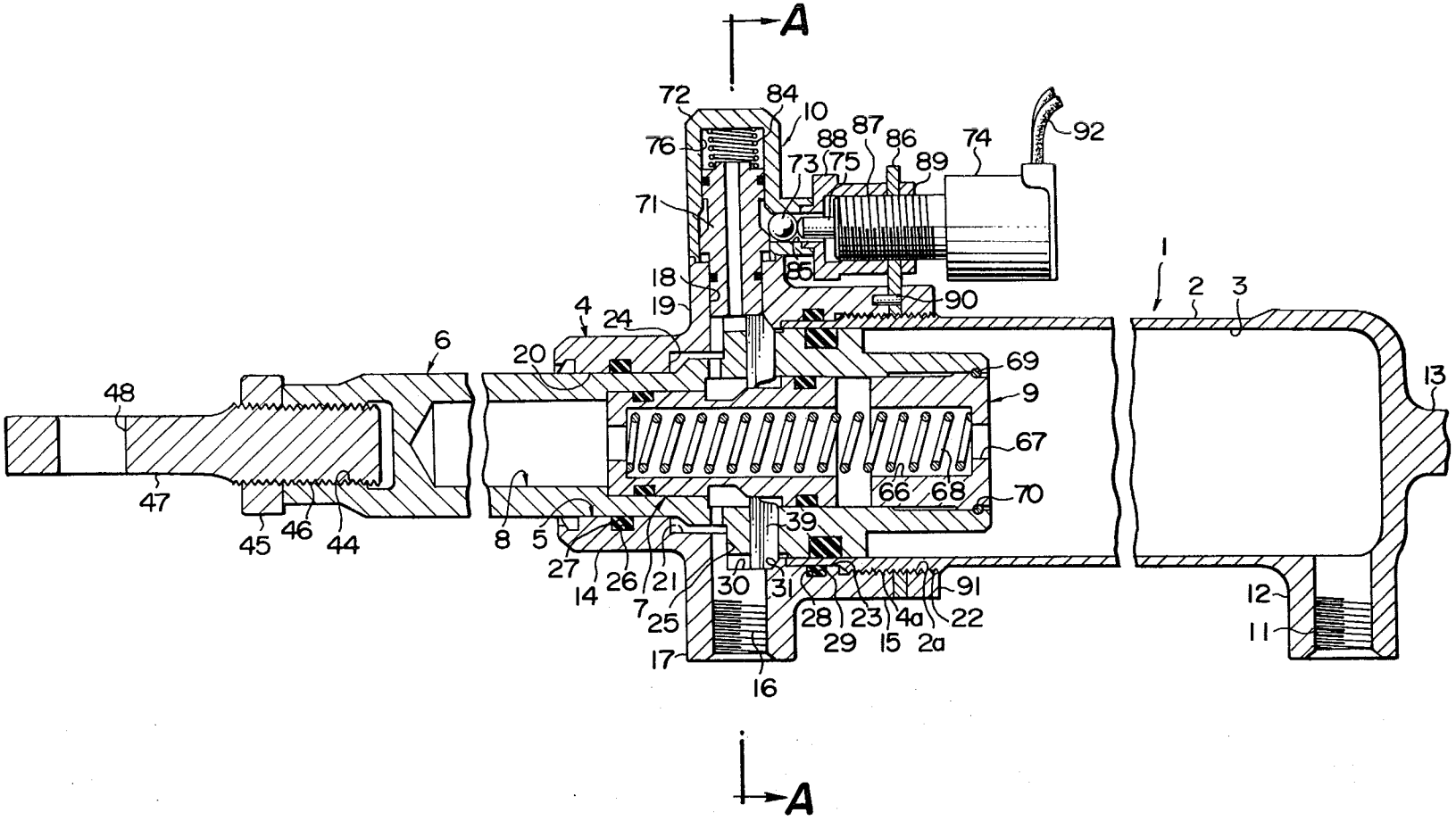
FIG. 1 is a cross-sectional view of one embodiment of a hydraulic actuator in accordance with the present invention.
Figure 2:
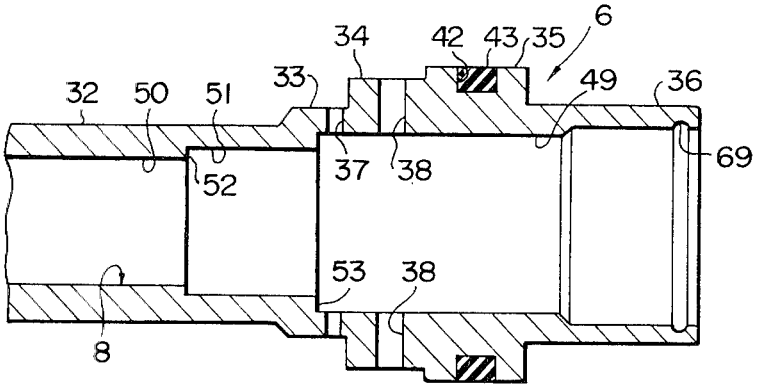
FIG. 2 is a fragmentary cross-sectional view of a piston employed in the above embodiment.
Figure 3:
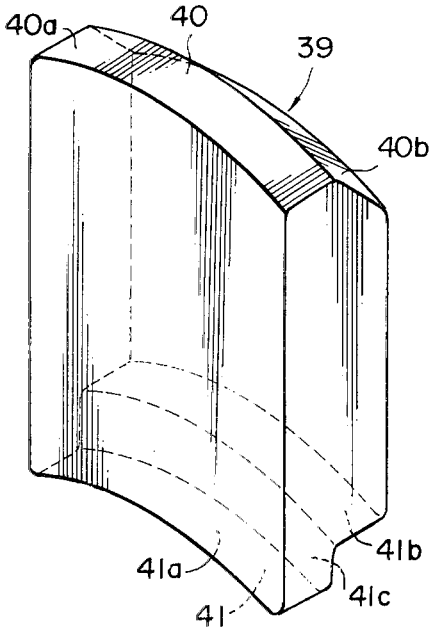
FIG. 3 is a perspective view of a locking member employed in the above embodiment.
Figure 5:
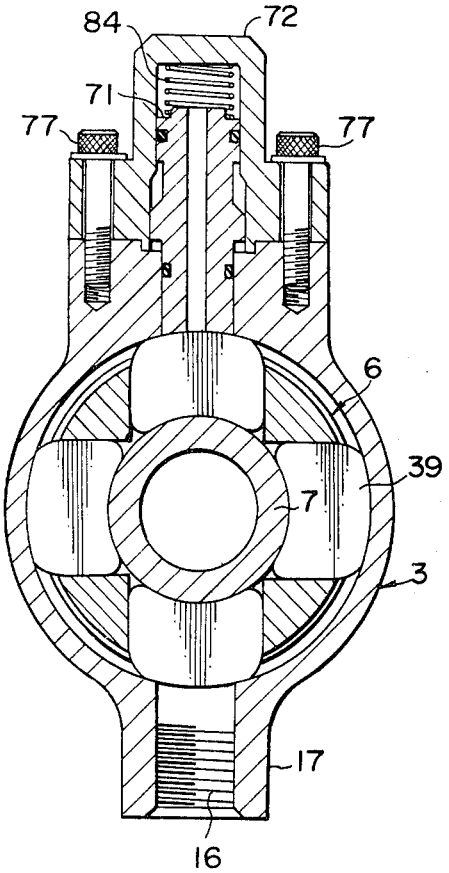
FIG. 5 is a cross-sectional view taken along the line A—A in FIG. 1.
Figure 4:
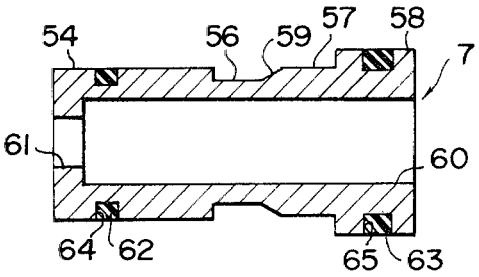
FIG. 4 is a cross-sectional view of a ram employed in the above embodiment.
Figure 6:
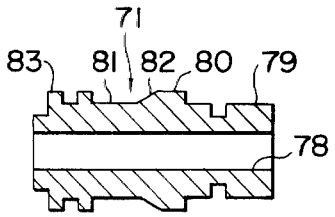
FIG. 6 is a cross-sectional view of a switch piston employed in the above embodiment.

Referring now to the drawings and in particular to FIG. 1, the reference numeral 1 generally designates a cylinder which includes a cylinder body 2 having therein a cylindrical hollow cavity 3 opened at the forward end thereof. The cylinder 1 further includes a cylinder end member, generally indicated at 4, which is formed at its rear inner peripheral wall with a screw 4*a* in threaded engagement with a screw 2*a* formed on the forward outer peripheral wall of the cylinder body 2. The cylinder end member 4 is formed with a cylindrical bore 5 in sliding engagement with the outer peripheral wall of a cylindrical piston, generally designated at 6, which is in turn axially slidably received in the hollow cavity 3 of the cylinder body 2. A closed bore generally indicated at 8 is formed in the piston 6 to extend axially and axially slidably receives a ran, generally denoted at 7, which is prevented from movement out of the opening portion of the closed bore 8 by means of a stop member also generally designated at 9 and fixedly received in the opening portion of the closed bore 8. On the central outer peripheral wall of the cylinder end member 4 is securely mounted a detecting mechanism, generally indicated at 10, which will be described in detail hereinafter. A first port projection 12 is formed at the rear outer peripheral wall of the cylinder body 2 and has therein a first port 11 which is connected at its one end with the hollow cavity 3 and at the other end with a hydraulic fluid source system not shown in any drawings. On the rear face of the cylinder body 2 is integrally formed a bracket 13 which is to be attached to a body of an aircraft. The cylinder end member 4 is formed to have a small diameter portion 14 and a large diameter portion 15 at its fore-half and rear-half outer peripheral walls, respectively, between which a second port projection 17 is formed to have therein a second port 16 which is connected at its one end with the cylindrical bore 5 and at the other end with the hydraulic fluid source system. On the circumferentially opposite side of the cylinder end member 4 to the second port projection 17 is formed integrally a switch piston projection 19 in which a radially extending bore 18 is formed to slidably receive a switch piston which will become apparent as the description proceeds. The cylindrical bore 5 formed in the cylinder end member 4 is formed to have on its inner peripheral wall from the fore end to the rear end thereof a small diameter portion 20, an intermediate diameter portion 21 and a large diameter portion 23, the small diameter portion 20 and the intermediate diameter portion 21 being connected by a stepped portion 24 while the intermediate diameter portion 21 and the large diameter portion 23 being connected by a stepped portion 25. On the inner peripheral wall of the small diameter portion 20 is formed an annular groove 26 which receives an oil seal ring 27 to complete sealing between the cylinder end member 4 and the piston 6. On the inner peripheral wall of the large diameter portion 23 is also formed an annular groove 28 which receives an oil seal ring 29 to complete sealing between the cylinder end member 4 and the cylinder body 2. The reference numeral 30 designates an annular groove which is provided at the fore end portion of the large diameter portion 23 in the vicinity of the stepped portion 25 and which has an inclined face 31 at a portion remote from the stepped portion 25, the inclined face 31 being engageable with the radially outer end of each of locking members, which will be apparent from the following description, to firmly lock the piston 6 and the cylinder end member 4. As shown in FIG. 2, the piston 6 is formed to have on its outer peripheral wall from the fore end to the rear end thereof a first diameter portion 32 with a diameter substantially equal to that of the small diameter portion 20 of the cylinder bore 5, a second diameter portion 33 with a diameter somewhat smaller than the intermediate diameter portion 21 of the cylinder bore 5 to be insertable thereinto, a third diameter portion 34 with a diameter somewhat smaller than that of the cavity 3 of the cylinder body 2, a forth diameter portion 35 with a diameter substantially equal to that of the cylinder cavity 3 of the cylinder body 2, and a fifth diameter portion 36 with a diameter somewhat larger than that of the second diameter portion 33. The piston 6 is therefore slidably received in the cavity 3 of the cylinder body 2 in such a way that the inner peripheral wall of the small diameter portion 20 of the cylindrical bore 5 of the cylinder end member 4 is held in sliding contact with the outer peripheral wall of the first diameter portion 32 while the inner peripheral wall of the cavity 3 is in turn held in sliding contact with the outer peripheral wall of the fourth diameter portion 35. In the second diameter portion 33 are circumferentially equidistantly and alignedly formed a plurality of radial bores 37 in communication with the closed bore 8 and the second port 16. In the third diameter portion 34 are circumferentially equidistantly and alignedly formed four radial bores 38 in communication with the closed bore 8, each of the radial bores 38 slidably receiving a plate-like locking member 39 which serves to lock the piston 6 with the cylinder body 2. As shown in FIG. 3, the radially outer end face 40 of each of the locking members 39 is formed to have an arcuate portion 40*a* with a curvature substantially the same to the inner peripheral face of cylinder body 2 and an inclined portion 40*b* formed rearwardly of and connected with the arcuate portion 40*a* with an inclination angle substantially equal to that of the inclined face 31, while the radially inner end face 41 is formed to have a first arcuate engaging portion 41*a*, a second arcuate engaging portion 41*b* at a position rear of the first engaging portion 41*a* and recessed radially outwardly from the first engaging portion 41*a*, and a stepped portion 41*c* connecting the first and second engaging portion 41*a* and 41*b*. The curvatures of the first and second engaging portions 41*a* and 41*b* are substantially the same to the outer peripheral face of an upper engaging portion 57 of the ram 7 which will be described hereinafter. As again shown in FIG. 2, an annular groove 42 is formed on the fourth diameter portion 35 of the piston 6 to receive an oil seal ring 43 for completion of sealing between the cylinder body 2 and the piston 6. On the forward end of the piston 6 is formed an axial bore 44 extending backwardly and in threaded engagement as at 46 with a rod 47 which is reliably fixed to the piston rod 6 by means of a lock nut 45. The rod 47 has at its forward end a bore 48 through which a suitable pin not shown is inserted to be connected with a landing wheel and the like of the aircraft. The closed bore 8 which is formed to extend from the rear end to the fore end of the piston 6 consists of a large diameter portion 49 with the radial bores 38 and the radial bores 37 opened, a small diameter portion 50 spaced forwardly of the large diameter portion 49 and having a diameter smaller than that of the large diameter portion 49, and an intermediate diameter portion 51 positioned between the large and small diameter portions 49 and 50 and having a diameter smaller than that of the large diameter portion 49 but larger than that of the small diameter portion 50. The small diameter portion 50 and the intermediate diameter portion 51 are connected by a stepped portion 52 while the large diameter portion 49 and the intermediate diameter portion 51 are connected by a stepped portion 53. With reference to FIGS. 4 and 5, the reference numeral 7 indicates a ram which is formed to have on its outer peripheral wall from the fore end to the rear end thereof a small diameter portion 54 having an outer diameter and a length substantially equal to those of the intermediate diameter portion 51 of the closed bore 8, a lower engaging portion 56 having an outer diameter substantially equal to the length obtained by subtracting from the inner diameter of the cavity 3 double the radial length of the locking member 39, an upper engaging portion 57 having an outer diameter substantially equal to the length obtained by subtracting from the inner diameter of the groove 30 double the radial length of the locking member 39, a large diameter portion 58 having an outer diameter substantially equal to the inner diameter of the large diameter portion 49 of the piston 6, and an inclined portion 59 connecting the lower engaging portion 56 and the upper engaging portion 57 with a circumferential length longer than that of the lower engaging portion 56. In the ram 7 are provided a large axial bore 60 which extends from its rear end toward its fore end and a small axial bore 61 which is in communication with the fore end of the ram 7 and the fore end of the large axial bore 60 with a diameter smaller than that of the large axial bore 60. The ram 7 is slidably received in the closed bore 8 of the piston 6 with the outer peripheral wall of the small diameter portion 54 engaging the inner peripheral wall of the intermediate diameter portion 51 and with the large diameter portion 58 engaging the inner peripheral wall of the large diameter portion 49 so that the locking members 39 slidably received in the radial bores 38 are engageable at their radially inner ends with any one of the lower engaging portion 56, the inclined portion 59 and the upper engaging portion 57 of the ram 7. On the outer peripheral walls of the small and large diameter portions 54 and 58 of the ram 7 are respectively formed annular grooves 62 and 63 in which oil seal rings 64 and 65 are respectively received for completion of sealing between the ram 7 and the piston 6. The stop member 9 which is fixedly received in the opening portion of the closed bore 8 is shown in FIG. 1 as formed to have therein a large axial bore 66 extending from its fore end toward its rear end and a small axial bore 67 in communication with the large axial bore 66 and the rear end of the stop member 9 and having an inner diameter smaller than that of the large axial bore 66. A compression coil spring 68 is accommodated in the large axial bore 60 of the ram 7 and the large axial bore 66 of the stop member 9 to urge the ram 7 toward the lower engaging portion 56 of the ram 7 from the upper engaging portion 57 of the ram 7 until the fore end of the ram 7 comes to be engaged with the stepped portion 52 of the piston 6. A lock ring 70 is received in an annular groove 69 formed on the inner peripheral wall at the opening portion of the closed bore 8 to securely retain the stop member 9 at the opening portion of the closed bore 8. The detecting mechanism 10 comprises a cover 72 slidably receiving a switch piston 71, and a detecting rod 75 for detecting reciprocation of the switch piston 71 and transmitting the same to an electric switch 74 through a spherical member 73. The electric switch 74 transmits a signal to a suitable indicating meter not shown. The detecting mechanism 10 thus serves to detect radially moved position of the locking member 39 through the switch piston 71 and to detect the piston 6 which is locked and unlocked so that the electric switch 74 transmits lock and unlock signals to the indicating meter as will be described together with the operation of the hydraulic actuator of the present invention. The cover 72 which is formed to have therein an axial closed bore 76 is mounted on the central outer peripheral wall of the cylinder end member by bolts 77 with the closed bore 76 concentrical to and in communication with the radial bore 18 of the cylinder end member 4. As shown in FIG. 6, the switch piston 71 which has therein an axial bore 78 extending throughout the length thereof is formed to have on its peripheral wall from the radially inner end to the radially outer end thereof a first diameter portion 79 with a diameter substantially equal to that of the radial bore 18 of the cylinder end member 4, a second diameter portion 80 having a diameter larger than the first diameter portion 79 and engageable with the spherical member 73, a third diameter portion 81 having a diameter smaller than that of the second diameter portion 80, an inclined portion 82 connecting the second diameter portion 80 and the third diameter portion 81, and a fourth diameter portion 83 having a diameter substantially equal to that of the axial closed bore 76. The switch piston 71 is accommodated in the cylinder end member 4 and the cover 72 in such a manner that the outer peripheral wall of the first diameter portion 79 is in sliding contact with the radial bore 18 while the outer peripheral wall of the fourth diameter portion 83 is also in sliding contact with the axial closed bore 76. A compression coil spring 84 is rested in the axial closed bore 76 between the bottom thereof and the radially outer end of the switch piston 71 so as to radially inwardly urge the switch piston 71 and the locking members 39. Provided in the cover 72 at right angles with the axial closed bore 76 is a horizontal bore 85 which has a diameter somewhat larger than that of the spherical member 73 and in which the spherical member 73 is horizontally movably received to be engageable with any one of the second diameter portion 80, the third diameter portion 81 and the inclined portion 82 of the switch piston 71. The reference numeral 86 designates a securing plate which is interposed between a first nut 88 in threaded engagement with a screw portion 87 of the electric switch 74 and a second nut 89 also in threaded engagement with the screw portion 87. The securing plate 86 is positioned by the cylinder end member 4 and a positioning pin 90 piercing the securing plate 86 so as to permit the fore end of the detecting rod 75 slidable within the screw portion 87 to be engageable with the spherical member 73, and secured to the cylinder end member 4 by a third nut 91 in threaded engagement with the screw 2a of the cylinder body 2. The reference numeral 92 designates a lead line connected at one end to the electric switch 74 and at the other end to an indicating meter not shown to transmit from the switch 74 to the meter such a lock signal that the piston 6 is locked to the cylinder end member 4 when the detecting rod 75 is retracted to a predetermined position by the spherical member 73 and such an unlocked signal that the piston 6 is unlocked to the cylinder end member 4 when the detecting rod 75 projected to a predetermined position. The lock and unlock signals are indicated on the indicating meter and the indications of the signals are used for control of the hydraulic fluid source system, in other words, for control of the movement of the piston 6 in a well known manner, for example, that a pilot of an aircraft manually operates the hydraulic fluid source system with confirmation of the indications of the signals on the indicating meter and further for example that the indicated signals are automatically related to a suitable automatic sequence control system provided provided in the hydraulic fluid source through the indicating meter.

The operation of the hydraulic actuator thus constructed will now be described hereinafter.

Firstly, the pressure of the hydraulic fluid source fed from the hydraulic source through the second port 16 is higher than that of the hydraulic fluid passing through the first port 11 so that the piston 6 is being stopped at the rearmost position of the cylinder cavity 3. At this time, the ram 7 remains compressing the compression coil spring 68 rearwardly with the force of the hydraulic fluid to have a rear end engaged with the stop member 9. The locking members 39 are held at their radially innermost positions wherein the first engaging portion 41*a* of each of the locking members 39 is in contact with the outer peripheral wall of the lower engaging portion 56 of the ram 7 and wherein the arcuate portion 40 of each of the locking members 39 is in contact with the inner peripheral wall of the cylinder cavity 3. By the force of the compression coil spring 84 the switch piston 71 is held at its radially innermost position wherein an annular stepped portion between the first diameter portion 79 and the second diameter portion 80 is abutted against the radially outer end of the switch piston projection 19. At this time, the spherical member 73 is in engagement with the outer peripheral wall of the third diameter portion 81 of the switch 71 so that the detecting rod 75 is projected to make the switch 74 off under which the switch is transmitting the off-signal as an unlock signal to the indicating meter and the indicating meter is indicating the unlock signal.

In order to have the piston 6 move forwardly from the previously mentioned state, the pressure of the hydraulic fluid in the second port 16 is lowered while the pressure of the hydraulic fluid in the first port 11 is heightened than that of the hydraulic fluid in the second port 16. As a result, the product of the pressure in the first port 11 and the cross-section area of the cylinder cavity 3 becomes larger than a force for sliding the piston 6 rearwardly, viz., the product of the pressure in the port 16 and the area obtained by subtracting the cross-section area of the first diameter portion 32 of the piston 6 from the cross-section area of the cylinder cavity 3 so that the piston 6 is moved forwardly to a position immediately before a stepped portion connecting the second diameter portion 33 and the third diameter portion 34 of the piston 6 is brought into engagement with the stepped portion 25 of cylinder end member 4. Under these circumstances, the second engaging portion 41*b* of each of the locking member 39 is held in engagement with the inclined portion 59 of the ram 7. The forward movement of the ram 7 is caused by the reason that the force to forwardly slide the ram 7 is larger than the force to rearwardly slide the ram 7. The force to forwardly slide the ram 7 is the addition of the repulsion force of the compression coil spring 68 and the product of the pressure in the first port 11 and the area obtained by subtracting the cross-section area of the small diameter portion 54 of the ram 7 from the cross-section area of the large diameter portion 58 of the ram 7, while the force to rearwardly slide the ram 7 is the product of the pressure in the second port 16 and the area obtained by subtracting the cross-section area of the small diameter portion 54 of the ram 7 from the cross-section area of the large diameter portion 58 of the ram 7. The further movement of the ram 7 is prevented, resulting from the locking members 39 positioned between the lower engaging portion 56 of the ram 7 and the inner peripheral wall of the cylinder cavity 3. When the piston 6 is then somewhat moved forwardly, the inclined portion 40*b* of each of the locking members 39 is engaged with the inclined face 31 of the cylinder end member 4 so that the locking members 39 are radially outwardly moved along the inclined face 31. The ram 7 which has been prevented from moving forwardly is thus somewhat moved forwardly. As a result, the locking members 39 radially moved together with the switch piston 71 along the inclined face 31 against the added force of the replusion force of the compression coil spring 84 and the product of the pressure in the second port 16 and the area obtained by subtracting the cross-section area of the first diameter portion 79 of the switch piston 71 from the cross-section area of the fourth diameter portion 83 of the switch piston 71. The force to radially inwardly move the switch piston 71 becomes a value as mentioned above due to provision of the axial bore 78 in the switch piston 71. The spherical member 73 is therefore moved rearwardly by the inclined portion 82 of the switch piston 71 to urge the detecting rod 75 to be retracted inwardly of the screw 87. When the piston 6 is further somewhat forwardly moved together with the ram 7, the second engaging portion 41*b* of each of the locking members 39 comes to be engaged with the upper engaging portion 57 of the ram 7 while the edge between the first engaging portion 41*a* and the stepped portion 41*c* of each of the locking members 39 is brought into engagement with the inclined portion 59 of the ram 7. This results in the piston 6 being not moved even if the rearward external force is exerted upon the piston 6. At this time, somewhat radially outwardly movements of the locking members 39 cause the switch piston 71 to be somewhat radially outwardly moved so that the spherical member 73 is urged by the inclined portion 82 of the switch piston 71, thereby causing the detecting rod 75 to be moved further toward the electric switch 74. The piston 6 therefore comes to be under an initial or first lock engagement position but the electric switch 74 is not energized and does not transmit a lock signal to the indicating meter. The manually or automatically controlled hydraulic fluid source system therefore continues to supply the fluid to the cylinder 1 so that the piston 6 is further moved forwardly. At this stage, no lock signal is indicated on the indicating meter and the pilot thus does not operate the manual control system of the hydraulic fluid source, or otherwise no lock signal is relayed to the automatic control system of the hydraulic fluid source through the indicating meter. As a result, the automatic control system is not energized even though the piston 6 and the cylinder 1 are under the first lock engagement positions. When the piston 6 is further moved forwardly until the stepped portion connecting the second and third diameter portions 33 and 34 of the piston 6 is brought into engagement with the stepped portion 25 of the cylinder end member 4, the piston 6 is stopped. The ram 7 is also stopped when the fore end of the ram 7 is abutted against the stepped portion 52 of the piston 6. Consequently, the locking members 39 are further somewhat radially outwardly moved so that the first engaging portion 41*a* and the upper engaging portion 57 of the ram 7 are engaged with each other while the inclined portions 40*b* of the locking members 39 are completely engaged with the inclined face 31 of the cylinder end member 4, thereby resulting in a final or second lock engagement condition. In this stage, the piston 6 is by no means moved even with the forward and rearward external force. The slight radially outward movements of the locking members 39 cause the switch piston 71 to be somewhat radially outwardly moved so that the spherical member 73 is moved toward the electric switch 74 by the inclined portion 82 of the switch piston 71. At this time, the detecting rod 75 is further retracted by the movement of the spherical member 73 to make the electric switch 74 on, which is transmitted through the lead line 92 to the external indicating meter and which is then indicated as a lock signal on the indicating meter. Therefore, the pilot can find and confirm the indication of the lock signal to operate the manual control system of the hydraulic fluid source for stopping the fluid supply. Or otherwise, the lock signal is relayed through the indicating meter to the automatic control system which is then energized to stop the fluid supply. The electric switch 74 may be adjusted to be energized between the first and second lock engagement conditions so that the lock signal is transmitted to the indicating meter. Since it is very difficult to completely match the transmission timing of the lock signal and the achievement timing of the second lock engagement condition, the adjustment can be effected by adjusting the first and second nuts 88 and 89 and the screw 87. If the lock signal is transmitted to the indicating meter immediately before the second lock engagement condition and the fluid supply to the cylinder 1 is stopped immediately before the second lock engagement condition, the ram 7, the locking members 39 and the piston 6 are about to be stopped at a semi-lock engagement position which is positioned immediately before the second lock engagement position. However because the ram 7 is being urged forwardly by the compression coil spring 68 which force acts on the locking members 39 and the piston 6 to be moved forwardly through two engagements, one of the engagements caused by the radially inner end portion 41 of each of the locking members 39 and the inclined portion 59 of the ram 7 and the other of the engagements caused by the inclined portion **40*b* of each of the locking members 39 and the inclined face 31 of the cylinder 1, the piston 6, the ram 7 and the locking members 39 are moved into their final engagement positions to complete the second lock engagement. The effect of the compression coil spring 68 is however unreliable since the force of the compression coil spring 68 is small compared with the hydraulic fluid force. Even though there is a possibility that the complete second lock engagement is not achieved by the force of the compression coil spring 68 as in the prior art, at least the first lock engagement is guaranteed according to the present invention. In this way, the provision of the stepped portion at the radially inner end of each of the locking members 39 enables the piston 6 to be locked immediately before the electric switch 74** is activated so that the aircrafts can fly under an extremely safe condition without being under an incomplete semi-locked state.

The release of the locked piston 6 will now be described hereinafter. When the pressure in the second port 16 is heightened over that in the first port 11 to make pressure difference over a predetermined level, the piston 6 is released from the locked state in a process inverse to the aforementioned process. Morespecifically, the force to rearwardly move the ram 7 becomes larger than the force to forwardly move the ram 7, thereby causing the ram 7 to rearwardly be moved. As a consequence, there is caused a gap between the radially inner end of each of the locking members 39 and the outer peripheral wall 56 of the ram 7 so that the locking members 39 are concurrently moved radially inwardly by means of the compression coil spring 84 through the switch piston 71 and a radially inwardly urging component imparted by the inclined face 31 resulting from the rearward movement of the piston 6. At this time, the spherical member 73 is forwardly moved along the inclined portion 82 of the switch piston 71 to project the detecting rod 75, thereby actuating the electric switch 74 to make it off. The off-signal is transmitted to the indicating meter as an unlock signal. When the ram 7 is then moved rearwardly until the rear end of the ram 7 comes to be in engagement with the fore end of the stop member 9, the locking members 39 are further moved radially inwardly until the first engaging portion **41*a* of the each of the locking members 39 is brought into engagement with the lower engaging portion 56 of the ram 7 so that the locking members 39 are released from their locked conditions and that the piston 6 can be rearwardly slidable. At this time, the switch piston 71 is radially inwardly moved by the action of the compression coil spring 84 and stopped when the stepped portion connecting the first diameter portion 79 and the second diameter portion 80 is engaged with the radially outer end of the switch piston projection 19. On the other hand, the detecting rod 75 is moved toward the switch piston 71 by the radially inward movement of the inclined portion 82 of the switch piston 71 to resume its initial position. In this way, the piston 6 is under its initial condition for reason that the force to rearwardly slide the piston 6 is larger than the force to forwardly slide the piston 6**. The above-mentioned operation is one cycle for one embodiment of the hydraulic actuators in accordance with the present invention which will be repeated hereinafter.

Figure 7:
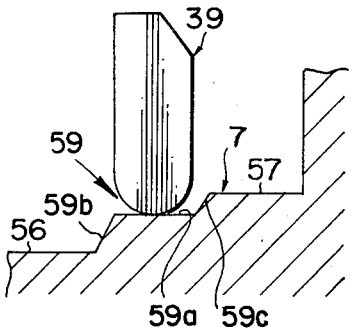
FIGS. 7 to 11 are schematic views of the locking members and the rams employed in other embodiments of the present invention.
Figure 8:
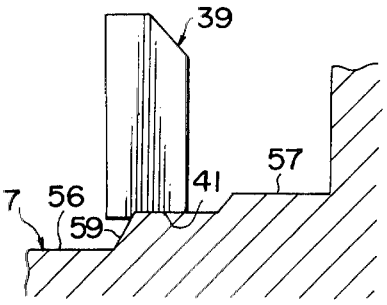
Figure 9:
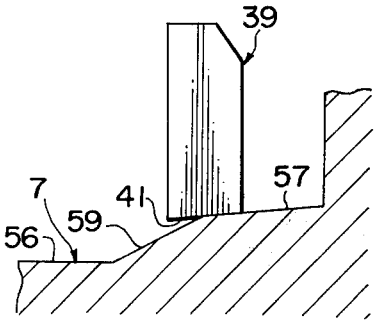
Figure 10:
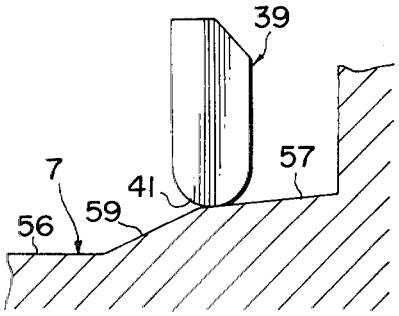
Figure 11:
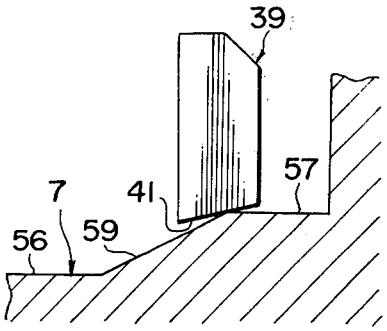

While it has been described that there has been provided a stepped portion at the radially inner end 41 of each of the locking members 39, the inclined portion 59 of the ram 7 may be steppedly formed as shown in FIG. 7, or both of the radially inner end 41 of each of the locking members 39 and the inclined portion 59 of the ram 7 may be steppedly formed as shown in FIG. 8. More specifically in FIG. 7, there is partially shown the ram 7 which has a lower engaging portion 56 slidably engageable with the radially inner face of the locking member 39, an upper engaging portion 57 axially spaced apart from the lower engaging portion 56 with a circumferential length longer than that of the lower engaging portion 56 and slidably engageable with the radially inner face of the locking member 39, a stepped portion **59*a* positioned between the lower and upper engaging portions 56 and 57 with a circumferential length longer than that of the lower engaging portion 56 but shorter than that of the upper engaging portion 57 and slidably engageable with the radially inner face of the locking member 39, a first inclined portion 59*b* connected at one end with the lower engaging portion 56 and at the other end connected with one end of the stepped portion 59*a* to be slidably engageable with the radially inner face of the locking member 39 for radial movement thereof, and a second inclined portion 59*c* connected at one end with the other end of the stepped portion 59*a* and at the other end connected with the upper engaging portion 57 to be slidably engageable with the radially inner face of the locking member 39 for radial movement thereof. In this case, when the radially inner face of the locking member 39 is in engagement with the lower engaging portion 56 of the ram 7, the locking member 39 assumes an unlocked engagement position wherein the piston 6 is in unlocked relation with the cylinder 1. When the radially inner face of the locking member 39 is then in engagement with the stepped portion 59***a* of the ram 7, the locking member 39 assumes a first lock engagement position wherein the electric switch 74 does not transmit a lock signal to the indicating meter. When the radially inner face of the locking member 39 is then in engagement with the upper engaging portion 57 of the ram 7, the locking member 39 assumes a second lock engagement position wherein the electric switch 74 is held transmitting a lock signal to the indicating meter. Further, both of the upper engaging portion 57 of the ram 7 and the radially inner end 41 of each of the locking members 39 may be slightly slanted as shown in FIG. 9. Either of the radially inner end 41 of each of the locking members 39 and the upper engaging portion 57 of the ram 7 may be slightly slanted as shown in FIGS. 10 and 11. There may be provided only one locking member in the present invention.

According to the present invention as mentioned above, the piston is completely locked immediately before the electric switch is actuated to transmit a locked signal to the external indicating meter so that the semi-locked condition of the piston can be absolutely avoided during flight of the aircrafts, resulting in remarkable enhancement of safety for the aircrafts.

Although particular embodiments of the present invention have been shown and described, it will be obvious to those skilled in the art that various changes and modifications may be made without departing from the spirit and scope of the present invention.

What is claimed is:

1. A hydraulic actuator for aircrafts, comprising:

a cylinder;

a main piston axially slidably received in said cylinder and having a hollow bore axially extending therein;

a liquid source system for supplying a liquid to said cylinder to relatively slidably move said cylinder and piston;

at least one locking member radially movably retained in said main piston;

a ram axially slidably received in said hollow bore of said main piston and having a lower engaging portion slidably engageable with the radially inner face of said locking member, an upper engaging portion axially spaced apart from said lower engaging portion with a circumferential length longer than that of said lower engaging portion and slidably engageable with the radially inner face of said locking member, a stepped portion positioned between said lower and upper engaging portions with a circumferential length longer than that of said lower engaging portion but shorter than that of said upper engaging portion and slidably engageable with the radially inner face of said locking member, a first inclined portion connected at one end with said lower engaging portion and at the other end connected with one end of said stepped portion to be slidably engageable with the radially inner face of said locking member for radial movement thereof, and a second inclined portion connected at one end with the other end of said stepped portion and at the other end connected with said upper engaging portion to be slidably engageable with the radially inner face of said locking member for radial movement thereof;

a compression coil spring accommodated in said bore of said main piston to urge said ram toward said lower engaging portion from said upper engaging portion;

a switch piston radially slidably mounted on said cylinder to have a radially inner face engageable with the radially outer face of said locking member;

an indicator for indicating lock and unlock engagement conditions of said cylinder and said main piston; and a detecting electric switch for detecting the radially moved position of said locking member through said switch piston to detect said main piston which is locked and unlocked and for transmitting lock and unlock signals to said indicator, whereby the radially inner face of said locking member is in engagement with said lower engaging portion of said ram to assume an unlock engagement position wherein said main piston is in unlocked relation with said cylinder, the radially inner face of said locking member is in engagement with said stepped portion of said ram to assume a first lock engagement position wherein said indicator indicates said unlock signal even though said cylinder and said main piston are in said first lock engagement condition, and the radially inner face of said locking member is in engagement with said upper engaging portion of said ram to assume a second lock engagement position wherein said indicator remains indicating said lock signal.

2. A hydraulic actuator for aircrafts, comprising:

a cylinder;

a main piston axially slidably received in said cylinder and having a hollow bore axially extending therein;

a liquid source system for supplying a liquid to said cylinder to relatively slidably move said cylinder and piston;

at least one locking member radially movably retained in said main piston and radially inwardly having a first inner engaging face, a second inner engaging face positioned radially outwardly of said first inner engaging face, and a stepped portion connecting said first and second inner engaging faces;

a ram axially slidably received in said hollow bore of said main piston and having a lower engaging portion slidably engageable with said first inner engaging face of said locking member, an upper engaging portion axially spaced apart from said lower engaging portion with a circumferential length longer than that of said lower engaging portion and slidably engageable with said first and second inner engaging faces of said locking member, and an inclined portion connected at one end with said lower engaging portion and at the other end connected with said upper engaging portion to be slidably engageable with said first and second inner engaging faces of said locking member for radial movement thereof;

a compression coil spring accommodated in said bore of said main piston to urge said ram toward said lower engaging portion from said upper engaging portion;

a switch piston radially slidably mounted on said cylinder to have a radially inner face engageable with the radially outer face of said locking member;

an indicator for indicating lock and unlock engaging conditions of said cylinder and said main piston; and a detecting electric switch for detecting the radially moved position of said locking member through said switch piston to detect said main piston which is locked and unlocked and for transmitting lock and unlock signals to said indicator, whereby the first inner engaging face of said locking member is in engagement with said lower engaging portion of said ram to assume an unlock engagement position wherein said main piston is in unlocked relation with said cylinder, the first inner engaging face of said locking member is in engagement with said inclined portion of said ram and the second inner engaging face of said locking member is in engagement with said upper engaging portion of said ram to assume a first lock engagement position wherein said indicator indicates said unlock signal even though said cylinder and said main piston are in said first lock engagement condition, and the first inner engaging face of said locking member is in engagement with said upper engaging portion of said ram to assume a second lock engagement position wherein said indicator remains indicating said lock signal.

* * * * *